US008390401B2

(12) United States Patent
Pruvost et al.

(10) Patent No.: US 8,390,401 B2
(45) Date of Patent: Mar. 5, 2013

(54) COPLANAR WAVEGUIDE

(75) Inventors: Sébastien Pruvost, Froges (FR); Frédéric Gianesello, D'Albigny (FR)

(73) Assignee: STMicroelectronics, SA, Montrouge (FR)

( * ) Notice: Subject to any disclaimer, the term of this patent is extended or adjusted under 35 U.S.C. 154(b) by 456 days.

(21) Appl. No.: 12/468,627

(22) Filed: May 19, 2009

(65) Prior Publication Data

US 2009/0284331 A1 Nov. 19, 2009

(30) Foreign Application Priority Data

May 19, 2008 (FR) ..... 08 53224

(51) Int. Cl.
*H01P 5/00* (2006.01)

(52) U.S. Cl. ..... 333/238; 333/4

(58) Field of Classification Search ..... 333/1, 4, 333/5, 238, 246
See application file for complete search history.

(56) References Cited

U.S. PATENT DOCUMENTS

| | | | | |
|---|---|---|---|---|
| 7,102,456 | B2 * | 9/2006 | Berg | 333/4 |
| 2007/0040626 | A1 * | 2/2007 | Blair et al. | 333/1 |
| 2008/0048796 | A1 | 2/2008 | Shaul et al. | |

FOREIGN PATENT DOCUMENTS

| | | |
|---|---|---|
| EP | 0917236 | 5/1999 |
| JP | 09093005 | 4/1997 |
| WO | 02103838 | 12/2002 |
| WO | 2007080529 | 7/2007 |

OTHER PUBLICATIONS

French Search Report based on Application Serial No. FR0853224, Institut National De La Propriete Industrielle, Nov. 11, 2008.

D. Budimir, Q. H. Wang, A. A. Rezazadeh and I. D. Robertson, "V-shaped CPW transmission lines for multilayer MMICs" , Electronics Letters, IEE Stevenage, GB,Oct. 26, 1995, pp. 1928-1930, vol. 31, No. 22.

J. L. B. Walker, "A Survey of European Activity on Coplanar Waveguide", Microwave Symposium Digest, 1993, IEEE MTT-S, pp. 693-696.

* cited by examiner

*Primary Examiner* — Stephen Jones
(74) *Attorney, Agent, or Firm* — Graybeal Jackson LLP

(57) ABSTRACT

An embodiment relates to a coplanar waveguide electronic device comprising a substrate whereon is mounted a signal ribbon and at least a ground plane. The signal ribbon comprises a plurality of signal lines of a same level of metallization electrically coupled together, and the ground plane is made of an electrically conducting material and comprises a plurality of holes.

26 Claims, 3 Drawing Sheets

COPLANAR WAVEGUIDE

PRIORITY CLAIM

The present application claims the benefit of French Patent Application Serial No.: 0853224, filed May 19, 2008, which application is incorporated herein by reference in its entirety.

TECHNICAL FIELD

An embodiment of the present disclosure relates to the field of passive components, particularly passive components for microwave electronic circuits such as coplanar waveguides.

Such components may be made, for example, by using the so-called silicon on insulator technology (SOI).

This manufacturing technology may be used, for example, as an alternative to crude silicon. With the use of highly resistive substrates, losses may be decreased and performances may be increased.

More specifically, an embodiment of the disclosure relates to a coplanar waveguide electronic device, able to propagate a microwave signal and comprising a substrate whereon is mounted a central signal ribbon and at least one ground plane, said central signal ribbon and said ground plane each being achieved as an assembly of at least one metallization layer, at least one metallization layer of the ground plane being able to cooperate with a same-level layer of the central signal ribbon for the propagation of the microwave signal.

SUMMARY

For the manufacture of such devices, there may exist a major constraint.

This constraint relates to the drawing rules on silicon. In fact, on silicon it is often not possible to draw solid metals beyond a certain threshold width, thus limiting the dimensions of the signal ribbon: for a given technology (65 nm, 130 nm, etc.), there exists a maximal width for the signal ribbon in full.

Beyond that, dishing problems may occur during the actual manufacture of electronic components: the layers (or levels) of metallization are mainly made of copper, "soft" material, in a frame of silicon dioxide SiO2, "hard" material. If the width of a copper strip is too wide, the copper strip may become hollow or bulge, and the final structure may hence lose its flatness, and the electronic component may become defective.

Furthermore, the metallic density should be respected, i.e., that for a given technology, there exists, during the manufacture, a control window, of determined dimensions, which, when moving above the electronic device, should detect a certain quantity of metal, minimal or maximal, for example, depending on the controlled area and the type of electronic device.

An embodiment of the present disclosure remedies these drawbacks by proposing a device, which further conforms to the description given above, wherein each metallization layer of the central signal ribbon able to propagate a microwave signal comprises a plurality of individual signal lines electrically coupled together for the propagation of said microwave signal.

Thanks to this configuration, the total width covered by the plurality of individual signal lines may be greater than the maximal width that may be given to a unique individual signal line without loss of flatness.

The signal lines may be separated from each other by a minimum distance, for example, by about 0.5 μm.

The set of individual signal lines may be parallel to each other and all coupled to one higher supply layer, typically of aluminum, the drawing constraints of which typically being much less restrictive, i.e., of which the maximal width may be much greater than the possible maximal width of one single individual line.

Thanks to this multi-line configuration, the density of metal at the central ribbon may be higher than that obtained by a central ribbon comprising only one single individual signal line (perforated in order to be achievable), while respecting the drawing rules for each individual signal line.

With regard to the ground plane, in an embodiment it is made of an electrically conducting material, typically of copper, and comprises a plurality of holes.

The holes may be spread in lines parallel to the central signal ribbon, each parallel line comprising holes identical and equidistant to each other.

In an embodiment, the dimension of the holes and/or the spacing between the holes form(s) a gradient of the signal ribbon towards the periphery of the ground plane. That is, the ground plane comprises a gradient of metallic density from the central signal ribbon towards the periphery of the ground plane.

The gradient of metallic density may be decreasing from the central signal ribbon towards the periphery of the ground plane.

In an embodiment, the substrate is a high resistivity type substrate.

With this configuration, the ground plane and the central signal ribbon may comprise a plurality of metallization layers at least any one of which is used for the propagation of a microwave signal.

Alternatively, the ground plane and the central signal ribbon may comprise a plurality of metallization layers at least any two metallization layers of which are electrically coupled together for the propagation of a microwave signal.

In another embodiment, all metallization layers are electrically coupled together for the propagation of a microwave signal.

At least the farthest metallization layer from the substrate of the ground plane may cooperate with the farthest metallization layer from the substrate of the central signal ribbon for the propagation of the microwave signal.

BRIEF DESCRIPTION OF THE DRAWINGS

Characteristics and advantages of one or more embodiments of the present disclosure may become more apparent from the following description given as an illustrative and non-limitative example with reference to the accompanying drawings, wherein.

DETAILED DESCRIPTION

Figure 1:
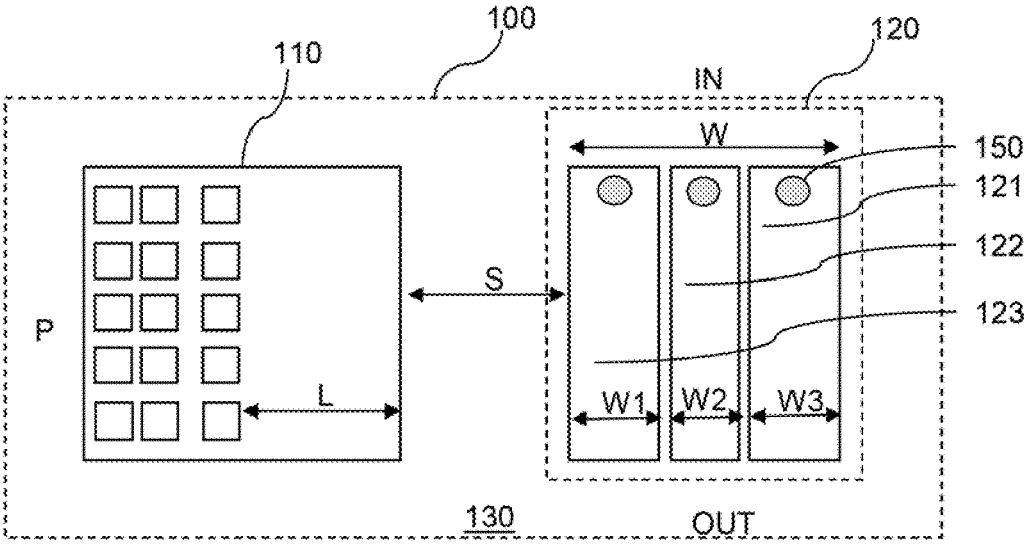
FIG. 1 shows a top view of part of the device according to an embodiment of the disclosure.

With reference to FIG. 1, a device 100 according to an embodiment of the disclosure is, a coplanar waveguide comprising a high resistivity substrate 130 whereon is mounted a signal ribbon 120 and at least one ground plane 110. By high resistivity, is meant a resistivity higher than, for example, 1 KΩ/cm.

To simplify the present description, another symmetrical ground plane with respect to the central signal ribbon is not represented nor described (although it may be present), its structure being the same as that of the ground plane 110.

In an embodiment, the central signal ribbon 120 comprises a plurality of signal lines 121, 122, 123 of widths W1, W2 and W3, respectively, and achieved at the same metallization level. The respective widths W1, W2 and W3 of signal lines 121, 122, 123 can be identical or not. These signal lines are electrically coupled together, for example, through vias 150, to a higher metallization level, usually in aluminum, not shown, serving as a supply.

In the structure represented in FIG. 1, the current propagates in one direction, along the signal lines, from entry IN towards the exit OUT of the ribbon.

In an embodiment of the disclosure, the metallic density at the central ribbon 120 may be maximal thanks to the transmission signal lines.

The total covered area, or the total width W, of the central signal ribbon 120 may then be higher than the maximal width W1 or W2 or W3 of one single signal line.

By way of non limitative example, in a 130 nm technology, the maximal width of a solid central ribbon (comprising only one single central signal line) of a sixth level of metal from the substrate often cannot exceed 11.99 μm, to prevent dishing.

According to an embodiment of the disclosure, the central signal ribbon comprises three identical signal lines, the dimensions of each signal line being W1=W2=W3=5 μm spaced apart by 0.5 μm. In this configuration, the width W of the central signal ribbon is thus of 16 μm.

In this configuration, the obtained metal density may be as high as approximately 93.75%, and the total width of ribbon W may then be higher than the maximal width of one single signal line, i.e., higher than the maximal width that the ribbon could have should it comprise one single signal line.

Thanks to this configuration, the resistance of the ribbon decreases, thus increasing the performances of the electronic component.

Another embodiment of the disclosure relates to the ground planes 110.

A ground plane 110 is separated from the central signal ribbon 120 by a slit of width S.

For a microwave signal to propagate properly, a specific metallic density should also be, or approximately be, obtained at the ground plane.

At the ground plane, the propagation mode is thus not unidirectional as in the central signal ribbon, but the current may propagate perpendicularly to the propagation direction of a signal line. Thus, with this ground plane structure, the current may propagate in two orthogonal directions (parallel and orthogonal to the signal ribbon).

And if the same solution as for the central signal ribbon is used, i.e., achieving the ground plane as a plurality of lines electrically coupled together, losses may be increased. Thus, this solution may not be desirable.

According to an embodiment, the structure of the ground plane comprises a set of holes, enabling the propagation of the current in these two orthogonal directions, and making it possible to prevent the afore-mentioned dishing problems.

As a result, such a device may also undergoes fewer losses at the ground.

In an embodiment, "hole" is meant a recess achieved in the metallization strip (e.g., copper or aluminum), said recess being filled with silicon dioxide $SiO_2$.

Figure 2:
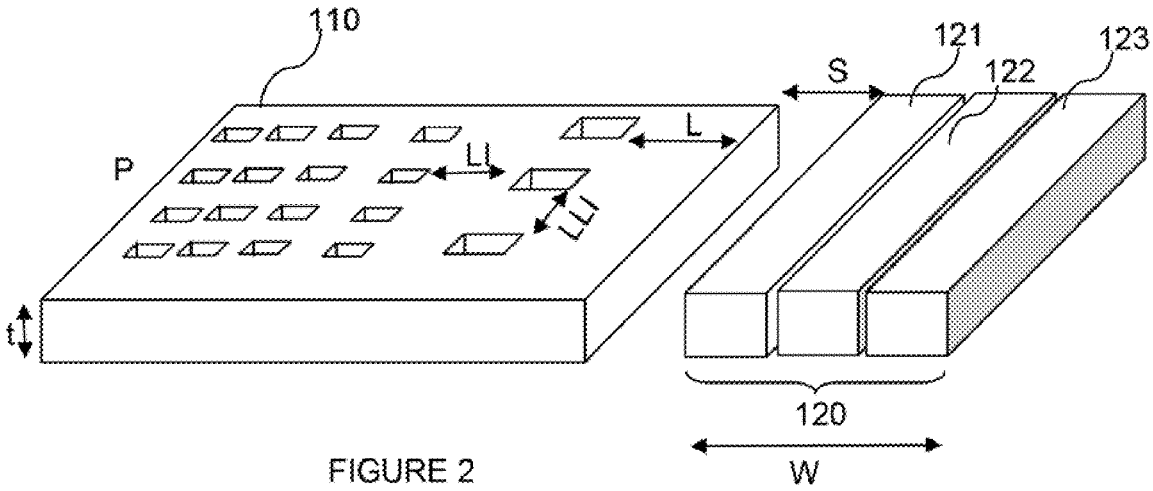
FIG. 2 shows a three-dimensional perspective view of FIG. 1.

As shown in FIG. 1 or FIG. 2, an embodiment of the structure comprises a ground plane 110, having a full width L, free from holes, and closest to the central signal ribbon 120, and wherein a number of holes are then carried out laterally, in order to reduce its density.

In FIG. 2, the central signal ribbon 120 has a width W and may be composed of a plurality of signal lines coupled to each other, as described previously.

The number of holes and their dimension as well as their position may be defined so as to respect the rules of metallic density (in the present case, for example, in a 130 nm technology, W=3 μm, s=3 μm and L=11.99 μm).

The holes made in the ground plane may be of variable dimensions and/or spacing, but in an embodiment are identical and equispaced along a same line parallel to the central signal ribbon The spacing LLI between two adjacent holes of a same line may differ from one line of holes to the next.

The spacing LI between two adjacent lines of holes may also be different along the ground plane.

In this way, it may be possible to define at the ground plane a gradient at the dimension of the holes from one line of holes to the next, and/or a gradient at the spacing between the holes of a same line of holes, as well as a gradient of the spacing between two adjacent lines of holes.

In an embodiment, the spacing LLI between two adjacent holes of a same line decreases from the central strip 120 towards periphery P of the ground plane (thus, the number of holes per line increases), and the spacing LI between two adjacent lines of holes decreases from the central strip 120 towards the periphery of the ground plane.

Thanks to this configuration, the current density is the highest at the areas near the central signal ribbon 120, which may reduce the global resistance of the propagation structure (ribbon) by a better distribution of electric-field lines.

The greater the portion of the ground plane width attributed to the full width L of the ground plane near the central signal ribbon, the more the lines of the electric field are confined in this area.

The further the last line of holes from the central ribbon, the more the magnetic-effect induced losses may be limited (flattening of the magnetic field lines).

Figure 3:
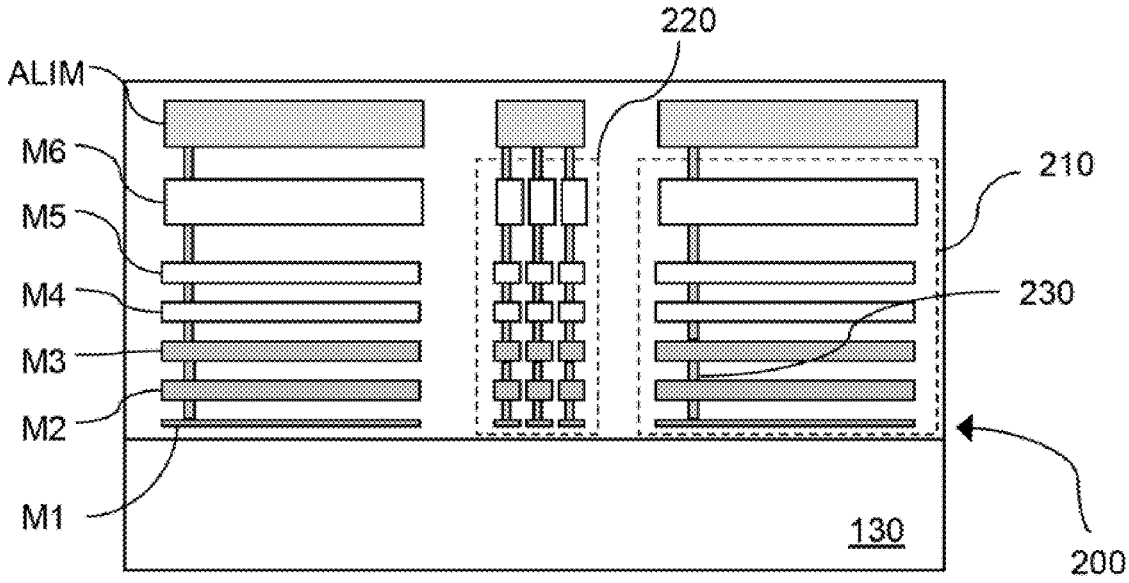
FIG. 3 shows a cross-section of an embodiment of the disclosure.

Furthermore, the structure of an electronic component according to an embodiment of the disclosure may be achieved as represented in FIG. 3.

FIG. 3 schematically represents an embodiment of a cross-section of an electronic device 200 such as a coplanar waveguide.

The coplanar waveguide 200 comprises a central signal ribbon 220. The central signal ribbon 220 may be achieved by a plurality of signal lines electrically coupled together as previously described.

Furthermore, the coplanar waveguide 200 comprises at least one ground plane 210. The ground plane 210 may be achieved as previously described.

As represented on FIG. 3, the coplanar waveguide 200 comprises a plurality of metallization layers, six in the present case, respectively M1 to M6.

The supply is ensured by an aluminum layer ALIM, which distributes the current by means, for example, of vias (not shown in FIG. 3).

It is known, that typically only the last metallization layer is typically used for the propagation of microwaves.

In an embodiment, last metallization layer, is meant the metallization layer, usually made of copper, the furthest away from the substrate 130, in the present case, the sixth layer M6.

According to an embodiment and surprisingly, on a high resistivity substrate 130, a metallization layer other than the last layer may be used for the transport of a microwave signal.

Furthermore, many layers may be used to this end, by electrically connecting them together, for example, by means of vias 230.

Contrary to conventional thinking [e.g., A. M. Mangan, S. P. Voinigescu, M. T. Yang, and M. Tazlauanu, "De-Embedding Transmission Line Measurements for accurate Modelling of IC Designs," IEEE Trans. Electron. Dev., Vol. ED-53, pp. 235-241, No. 2, 2006 which is incorporated by reference], the use of a layer lower than the last metallization layer for the propagation of a microwave on a high resistivity substrate may not increase the parasitic capacitance with respect to the substrate.

In the non limitative example shown in FIG. 3, only the first, second, and third metallization layers, respectively M1, M2, and M3, are coupled together by means of vias 230 such that together these three layers may carry a microwave signal.

In another embodiment, one single metallization layer, possibly other than the last layer, may be used for the transport of a microwave signal. In the present embodiment, one of the metallization layers M1 to M6.

In other embodiments, other combinations of layers may be used for the transport of a microwave signal. Embodiments of the disclosure comprise all possible combinations of metallization layers, from two or more layers, to the use of all metallization layers.

The supply of the metallization layers used for the transport a microwave signal may be ensured by the supply layer ALIM.

The combination of layers used may be determined according to the possibility to use, or not use, highly resistive substrates, as well as by constraints of integration with other components or of routing (e.g., the necessity to leave a metal level available for other connections).

An embodiment of the disclosure may be carried out in the microwave field, particularly for the achievement of filters at 90 GHz.

An embodiment of a coplanar waveguide device such as described above may be part of an electronic system, such as a microwave communication system.

Naturally, in order to satisfy local and specific requirements, a person skilled in the art may apply to the embodiments described above many modifications and alterations. Particularly, although one or more embodiments have been described with a certain degree of particularity, it should be understood that various omissions, substitutions, and changes in the form and details as well as other embodiments are possible. Moreover, it is expressly intended that specific elements and/or method steps described in connection with any disclosed embodiment may be incorporated in any other embodiment as a general matter of design choice.

What is claimed is:

1. An integrated circuit, comprising:

a substrate;

a first waveguide portion disposed at a first level over the substrate and including signal conductors, wherein the signal conductors are electrically coupled to one another through conductive vias; and a second waveguide portion disposed over the substrate at substantially the first level and including at least one reference conductor.

2. The integrated circuit of claim 1 wherein the first conductors are substantially parallel to one another.

3. The integrated circuit of claim 1 wherein at least two of the first conductors each have substantially a same width.

4. The integrated circuit of claim 1 wherein at least two of the first conductors have significantly different widths.

5. The integrated circuit of claim 1 wherein:

the first conductors each have a respective width; and at least two of the first conductors are spaced apart by a distance that is significantly smaller that a smallest of the respective widths.

6. The integrated circuit of claim 1 wherein:

at least two of the first conductors are spaced apart by a first distance; and the first waveguide portion is spaced apart from the second waveguide portion by a second distance that is greater than the first distance.

7. The integrated circuit of claim 1 wherein the first conductors comprise a metal.

8. The integrated circuit of claim 1 wherein the first conductors have substantially a same thickness.

9. The integrated circuit of claim 1 wherein at least one of the first conductors and the at least one second conductor have substantially a same thickness.

10. The integrated circuit of claim 1, further comprising:

a third conductor disposed over the substrate at a second level; and respective conductive vias that each electrically couple a respective one of the first conductors to the third conductor.

11. The integrated circuit of claim 1 wherein the substrate comprises a semiconductor substrate.

12. An integrated circuit, comprising:

a substrate;

a first waveguide portion disposed at a first level over the substrate and including at least one first conductor; and a second waveguide portion disposed over the substrate at substantially the first level and including at least one second conductor and a plurality of nonconductive regions disposed within the at least one second conductor;

wherein the second waveguide portion includes nonconductive regions disposed in a column within the at least one second conductor, at least two of the nonconductive regions having different dimensions.

13. The integrated circuit of claim 12 wherein the second waveguide portion includes at least two nonconductive regions disposed within the at least one second conductor.

14. The integrated circuit of claim 12 wherein the second waveguide portion includes nonconductive regions disposed in a column within the at least one second conductor, the column being substantially parallel to the first waveguide portion.

15. The integrated circuit of claim 12 wherein the second waveguide portion includes nonconductive regions disposed in a column within the at least one second conductor, at least two of the nonconductive regions having substantially the same dimensions.

16. The integrated circuit of claim 12 wherein the second waveguide portion includes nonconductive regions disposed in a column within the at least one second conductor, each nonconductive region spaced from adjacent nonconductive regions by substantially a same distance.

17. The integrated circuit of claim 12 wherein the nonconductive region comprises an electrical insulator.

18. The integrated circuit of claim 12 wherein the second waveguide portion includes nonconductive regions disposed in at least three columns within the at least one second conductor, a first and second of the columns being separated from one another by a first distance, and the second and a third of the columns being separated substantially by a second distance that is different from the first distance.

19. The integrated circuit of claim 12 wherein the substrate comprises a semiconductor substrate.

20. The integrated circuit of claim 12 wherein the nonconductive region at least as thick as the at least one second conductor.

21. An integrated circuit, comprising:

a substrate;

a first waveguide portion disposed at a first level over the substrate and including at least one first conductor; and a second waveguide portion disposed over the substrate at substantially the first level and including at least one second conductor and a plurality of nonconductive regions disposed within the at least one second conductor;

wherein the second waveguide portion includes nonconductive regions disposed in a column within the at least one second conductor, a first pair of the nonconductive regions spaced apart by a first distance, a second pair of the nonconductive regions spaced apart by a second distance that is different from the first distance.

22. An integrated circuit, comprising:

a substrate;

a first waveguide portion disposed at a first level over the substrate and including at least one first conductor; and a second waveguide portion disposed over the substrate at substantially the first level and including at least one second conductor and a plurality of nonconductive regions disposed within the at least one second conductor;

wherein the second waveguide portion includes nonconductive regions disposed in at least two columns within the at least one second conductor, a first of the columns closest to the first waveguide portion spaced from the first waveguide portion by a distance, a second of the columns spaced from the first column by substantially the distance.

23. An integrated circuit, comprising:

a substrate;

a first waveguide portion disposed at a first level over the substrate and including at least one first conductor; and a second waveguide portion disposed over the substrate at substantially the first level and including at least one second conductor and at least one nonconductive region disposed within the at least one second conductor;

wherein the second waveguide portion includes, nonconductive regions disposed in at least two columns within the at least one second conductor, a first of the columns closest to the first waveguide portion spaced from the first waveguide portion by a first distance, and a second of the columns spaced from the first column by a second distance that is different than the first distance.

24. An integrated circuit, comprising:

a substrate;

a first waveguide portion disposed at a first level over the substrate and including at least one first conductor; and a second waveguide portion disposed over the substrate at substantially the first level and including at least one second conductor and a plurality of nonconductive regions disposed within the at least one second conductor;

wherein the second waveguide portion includes nonconductive regions disposed in at least three columns within the at least one second conductor, a first and second of the columns being separated from one another by a distance, and the second and a third of the columns being separated substantially by the distance.

25. An integrated circuit, comprising:

a substrate;

a first waveguide portion disposed at a first level over the substrate and including at least one first conductor; and a second waveguide portion disposed over the substrate at substantially the first level and including at least one second conductor and a plurality of nonconductive regions disposed within the at least one second conductor;

wherein the second waveguide portion includes nonconductive regions disposed in at least two columns within the at least one second conductor, the nonconductive regions in a first of the columns being spaced apart from one another by a distance, the nonconductive regions in a second of the columns being spaced apart from one another substantially by the distance.

26. An integrated circuit, comprising:

a substrate;

a first waveguide portion disposed at a first level over the substrate and including at least one first conductor; and a second waveguide portion disposed over the substrate at substantially the first level and including at least one second conductor and a plurality of nonconductive regions disposed within the at least one second conductor;

wherein the second waveguide portion includes nonconductive regions disposed in at least two columns within the at least one second conductor, the nonconductive regions in a first of the columns being spaced apart from one another by a first distance, the nonconductive regions in a second of the columns being spaced apart from one another substantially by a second distance that is different from the first distance.

* * * * *